United States Patent [19]

Marietta

[11] 3,945,764

[45] Mar. 23, 1976

[54] VARIABLE DISPLACEMENT PUMP CONTROL ASSEMBLY

[75] Inventor: Walter E. Marietta, Mentor, Ohio

[73] Assignee: Parker-Hannifin Corporation, Cleveland, Ohio

[22] Filed: Sept. 5, 1974

[21] Appl. No.: 503,249

[52] U.S. Cl. ..... 417/212; 91/506

[51] Int. Cl.[2] ..... F04B 1/26

[58] Field of Search ..... 91/506; 417/212, 213, 218, 417/222; 60/445

[56] References Cited

UNITED STATES PATENTS

| | | | |
|---|---|---|---|
| 2,845,876 | 8/1958 | Keel | 417/222 |
| 3,067,693 | 12/1962 | Lambeck | 417/219 |
| 3,302,585 | 2/1967 | Adam et al. | 417/222 |
| 3,601,504 | 9/1969 | McBurnett | 417/213 |
| 3,635,021 | 1/1972 | McMillen | 417/222 |
| 3,669,570 | 6/1972 | Himmler | 91/506 |
| 3,738,779 | 6/1973 | Hein et al. | 91/506 |

*Primary Examiner*—William L. Freeh

*Attorney, Agent, or Firm*—Donnelly, Maky, Renner & Otto

[57] ABSTRACT

A variable displacement pump control assembly as for an axial piston pump having a swash plate actuating piston characterized in that the control assembly is embodied in the pump housing to provide a pressure compensated pump, or to provide a pressure compensated pump having an auxiliary modulator to control the pressure applied to the swash plate actuating piston to maintain a predetermined pressure drop across a variable area metering orifice embodied as in a directional control valve for a fluid motor, or to provide a pressure compensated pump having a horsepower modulator with or without the auxiliary modulator, said horsepower modulator providing desired control of horsepower in relation to pump delivery pressure and displacement.

14 Claims, 4 Drawing Figures

Fig. 1

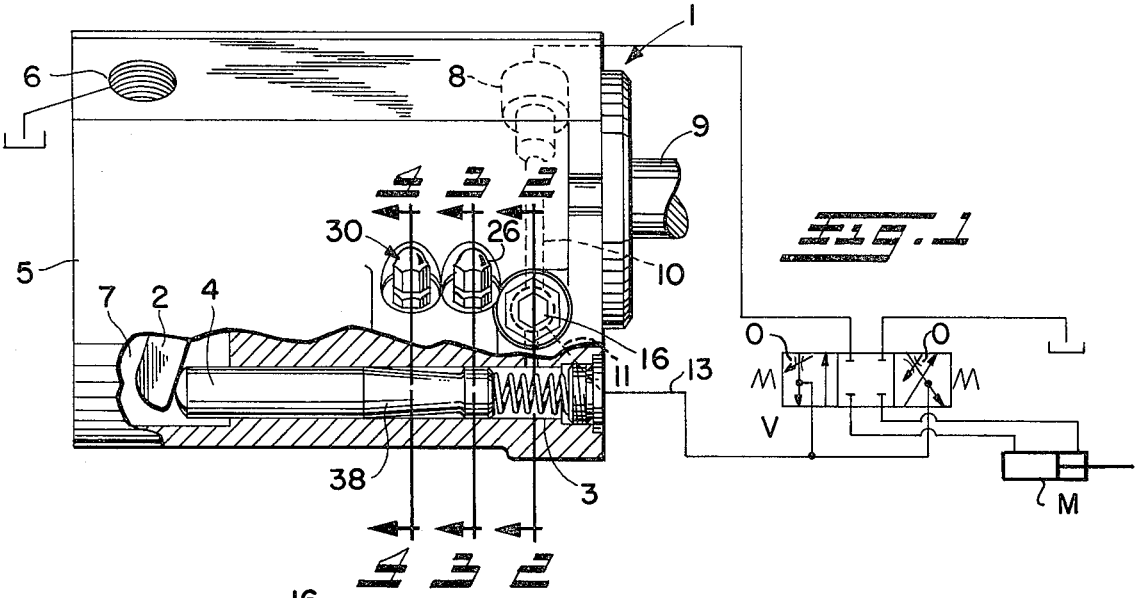
FIG. 1
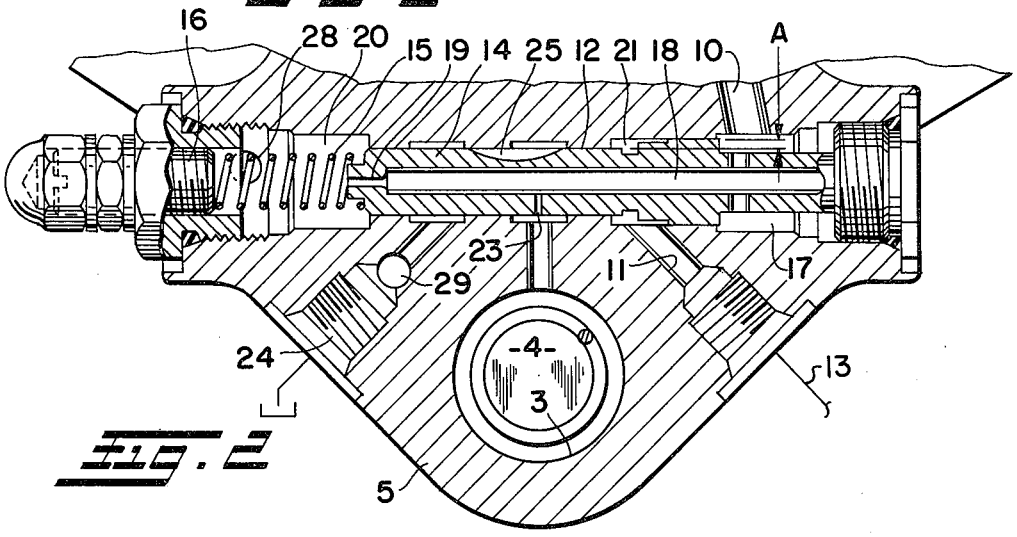
FIG. 2
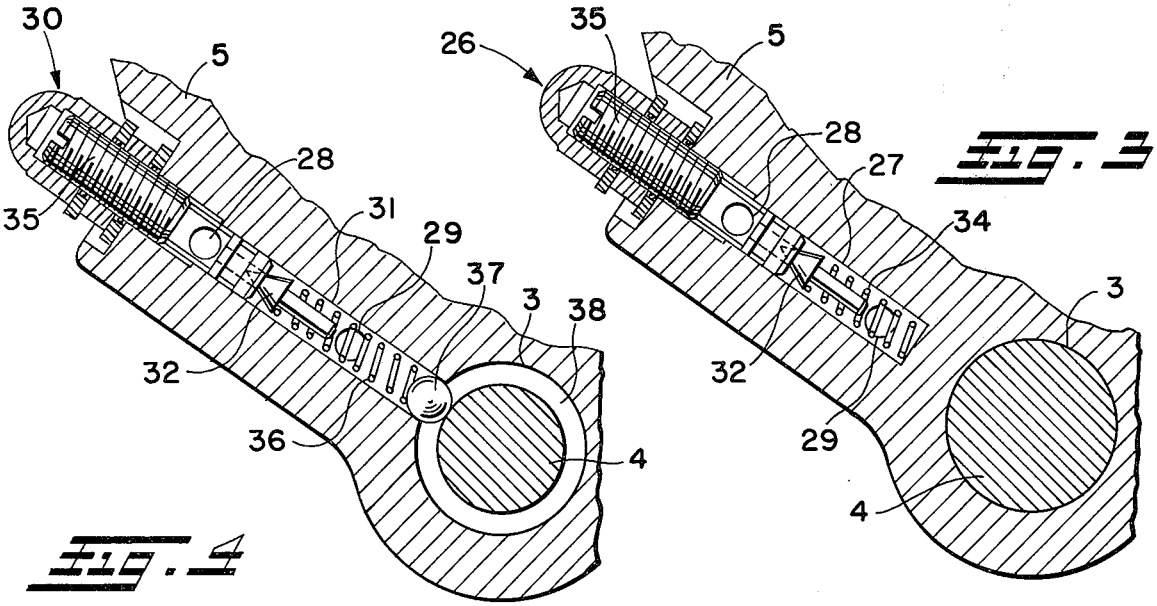
FIG. 3
FIG. 4

VARIABLE DISPLACEMENT PUMP CONTROL ASSEMBLY

BACKGROUND OF THE INVENTION

Axial piston variable displacement pumps with hydraulic swash plate actuators are well known in the art but in known constructions when it is desired to provide for pressure compensation with or without auxiliary modulation or to provide for pressure compensation with horsepower modulation (with or without auxiliary modulation), it has been necessary to provide a corresponding number of different pump housings or pump control assemblies with attendant substantially increased production and inventory costs.

SUMMARY OF THE INVENTION

The variable displacement pump control assembly herein is embodied in a single form of pump housing to selectively provide for pressure compensation, for pressure compensation with auxiliary modulation, for pressure compensation with horsepower modulation, or for pressure compensation with both auxiliary and horsepower modulation.

Other objects and advantages will appear from the ensuing description.

BRIEF DESCRIPTION OF THE DRAWING

FIG. 1 is a side elevation view, partly in cross-section, of a variable volume pump in which the housing thereof embodies the pump control assembly;

FIGS. 2, 3 and 4 are cross-section views taken substantially along the lines 2—2, 3—3, and 4—4 of FIG. 1;

DETAILED DESCRIPTION OF THE PREFERRED EMBODIMENTS

The pump 1 herein shown by way of illustrative example is an axial piston pump such as that shown in U.S. Pat. No. 3,726,093 in which the displacement is varied by changing the angular position of the swash plate 2, such change in swash plate angle being hydraulically effected by control of fluid pressure in the bore 3 in which the swash plate actuating piston 4 is axially movable. The pump housing 5 has an intake port 6 leading into the intake chamber 7 and has an outlet or delivery port 8 from which fluid under pressure is delivered upon driving of the drive shaft 9 which is journaled in said housing 5 in well known manner.

The pump 1 illustrated in FIGS. 1 to 4 provides for pressure compensation, auxiliary modulation, and horsepower modulation, all of which functions are accomplished in the unitary pump housing 5, and, as hereinafter explained in detail, the auxiliary modulation and/or the horsepower modulation may be omitted without any changes in the pump housing 5 other than plugging unused passages.

In the use of the FIGS. 1 through 4 pump 1, the outlet port 8 may be connected to the inlet port of a directional control valve assembly V and, in turn, the motor ports of the directional control valve assembly V will be connected to a fluid motor M. In a preferred form of application of the pump 1, the directional control valve assembly V may define therewithin a variable area orifice O which is of size depending upon the extent of movement of the valve member thereof to an operating position thus to vary the speed of actuation of the fluid motor M irrespective of load pressure. Accordingly, the pump 1 control should maintain a predetermined pressure drop across such variable area orifice O.

The pump housing 5 herein is provided with high and low signal passages 10 and 11 which respectively sense the pressures upstream and downstream of such variable area orifice O, the high signal passage 10 communicating with the outlet port 8, and the low signal passage 11 being communicated by conduit 13 with the downstream side of the variable area orifice O as shown herein and, for example, in said U.S. Pat. No. 3,726,093 and in the copending U.S. application of John C. Paul, Ser. No. 394,560, filed Sept. 6, 1973.

Within a stepped bore 12 in the pump housing 5 is an auxiliary modulator 14 which is urged to the position shown in FIG. 2 by a spring 15 which is adjusted to desired compression by the adjusting screw 16. The high signal pressure in the passage 10 is conducted to the chamber 17 at the right end of modulator 14, and through the modulator bore 18 and orifice 19 into the chamber 20 at the left end of modulator 14 whereby the high signal pressure acts on the annular area A tending to urge the modulator 14 toward the left.

The low signal pressure in the passage 11 is conducted to the chamber 21 of annular area A to tend to move the modulator 14 to the position shown together with the assistance of the spring 15 when the pressure differential between the high and low signals is less than desired predetermined value hence indicating a flow through the variable area orifice O less than demanded thereby. Accordingly, the high signal pressure in passage 10 and chamber 17 is conducted to the piston bore 3 via the modulator orifice 23 to move the swash plate actuating piston 4 in displacement increasing direction. When the pump 1 displacement satisfies the flow demand set by the variable area orifice O, the pressure drop therethrough has increased and, hence the pressure differential in the chambers 17 and 21 has increased whereby the modulator 14 will be urged to the left against the spring 15 with metered bleeding of the piston bore 3 to the drain port 24 via the metering slot 25 in the modulator 14 thus to maintain the pump 1 displacement to satisfy the demanded flow.

The chamber 20 at the left end of the modulator 14 which has communication with the high signal pressure passage 10 via the bore 18 and orifice 19, is normally closed, but under certain conditions of operation of the pump 1, said chamber 20 is communicated with the drain port 24 either by a constant pressure pilot valve assembly 26 (FIG. 3) disposed in a bore 27 which interconnects the parallel bores 28 and 29 leading respectively to the chamber 20 and to the drain port 24 as shown in FIGS. 2 and 3, or by a horsepower control pilot valve assembly 30 (FIG. 4) disposed in a bore 31 which also interconnects the parallel bores 28 and 29.

Referring now to FIGS. 1, 2 and 3 it can be seen that when the high signal pressure in chamber 20 increases to value sufficient to unseat the pilot valve member 32 against the force of the spring 34, the chamber 20 will be communicated with the drain port 24 via passages 28, 27, and 29 and hence the pressure in the chamber 20 will decrease with respect to the pressure in chamber 17 by reason of the pressure drop across the orifice 19 in the modulator 14 whereby the predominant pressure in chamber 17 acting on the right-hand end of the modulator 14 will force the same toward the left to bleed the swash plate piston chamber 3 through slot 25 thus to decrease the capacity of the pump 1. When the pressure in the modulator chamber 20 decreases below such predetermined value the pilot valve member 32 closes whereby the movements of the modulator 14 are then controlled by the high signal and low signal pressure differentials to maintain the flow demanded by the variable area orifice O associated with the directional control valve V for the fluid motor M. The constant pressure pilot valve 26 comprises a body 35 having adjustable screw threaded engagement with the pump 5 housing and is provided with a seat with which the pilot valve member 32 is engaged. By reason of the screw threaded engagement of the body 35 in the pump housing 5, the compression of the spring 34 may be adjusted to vary the opening pressure of the pilot valve member 32.

With reference to FIGS. 1, 2 and 4 the horsepower control pilot valve 30 is similar to the constant pressure pilot valve 26 in that it also comprises a body 35 having an adjustable screw threaded connection with the pump housing 5 and is provided with a seat engaged by the pilot valve member 32. In this case, the spring 36 is compressed between the pilot valve member 32 and a ball 37 which has engagement with a cam surface 38 on the swash plate piston 4, the cam surface 38 being shaped to provide desired characteristics in the horsepower curve of the pump 1. As the displacement of the pump 1 decreases, i.e. as the swash plate piston 4 moves toward the right as viewed in FIG. 1, the ball 37 is urged radially outward (see FIG. 4) to increase the compression of the spring 36 and thus to increase the pressure at which the horsepower control pilot valve member 32 opens, and as just described in connection with the constant pressure pilot valve 26, the opening of the horsepower control pilot valve 30 will communicate the modulator chamber 20 with the drain port 24 via passages 28, 31, and 29 whereby the modulator 14 can then again move to the left as viewed in FIG. 2 to bleed off the pressure in the chamber 3 of the swash plate piston 4. It is to be understood that the cam surface 38 may be provided with a straight taper as shown or a concave or convex taper to provide any desired characteristics in the horsepower curve of the pump 1.

It is to be understood that if the pump 1 is to be pressure compensated with auxiliary modulation but without horsepower modulation it is a simple matter to omit the entire horsepower control pilot valve 30 and to screw in a plug to close the bore 31 between the bores 28 and 29. Similarly, if the pump 1 is to be pressure compensated with horsepower modulation but without auxiliary modulation, a plug is installed into the pump housing 5 to close the low signal passage 11 and no adjustment mechanism 16 need be provided for the spring 15, i.e. a plug may be substituted for the spring adjusting mechanism 16 shown in FIG. 2.

The embodiments of the invention in which an exclusive property or privilege is claimed are defined as follows:

1. Compensating means for a variable displacement pump of the type comprising a housing having pump means, high and low fluid pressure zones, and a fluid pressure actuated member having restricted communication with said high pressure zone and operatively engaged with said pump means to vary the displacement thereof; said compensating means comprising a valve member movable in said housing between positions opening and closing a bleed passage from said fluid pressure actuated member to said low pressure zone; spring means in said housing biasing said valve member to a position closing said bleed passage; said valve member having first opposed areas including an area on one side exposed to fluid pressure in said high pressure zone and an area on the other side exposed to fluid pressure in said high pressure zone via orifice means; said valve member having second opposed areas respectively exposed to fluid pressure in said high pressure zone and to a fluid pressure sensing passage in said housing which is communicated with the downstream side of a variable area orifice in the pressure feed path between said high pressure zone and a fluid motor actuated by fluid flowing from said high-pressure zone through said variable area orifice; said spring means retaining said valve member in said bleed passage closing position when the differential in fluid pressures acting on said second opposed areas is less than predetermined value; pressure and horsepower compensating pilot valves in said housing each operative, upon increase of fluid pressure in said high pressure zone to predetermined value, to open communication between said other side of said valve member and said low pressure zone for movement of said valve member by the then predominant fluid pressure acting on said one side of said valve member to open said bleed passage to bleed fluid pressure acting on said fluid pressure actuated member to said low pressure zone with consequent movement of said fluid pressure actuated member in pump displacement decreasing direction; each pilot valve including a spring biased pilot valve member with said horsepower compensating pilot valve having a spring follower engaged with a cam surface on said fluid pressure actuated member operative to increase the spring bias on the pilot valve member of said horsepower compensating pilot valve as said fluid pressure actuated member moves in a displacement decreasing direction; the aforesaid pressure differential, when exceeding such predetermined value, effecting movement of said valve member against said spring means to open said bleed passage to bleed said fluid pressure actuated member to said low pressure zone while said pilot valves are closed whereby said fluid pressure actuated member moves in a displacement decreasing direction.

2. The compensating means of claim 1 wherein said housing has adjustment means for said spring means to change the pressure differential at which said valve member is moved to bleed passage opening position while said pilot valves are closed.

3. The compensating means of claim 1 wherein said housing has a first passage communicating said other side of said valve member with the upstream sides of said pilot valves, and a second passage communicating the downstream sides of said pilot valves with said low pressure zone whereby the opening of either or both of said pilot valves effects movement of said valve member to open said bleed passage to bleed fluid pressure acting on said fluid pressure actuated member to said low pressure zone.

4. The compensating means of claim 3 wherein said pilot valves are disposed in parallel bores in said housing each of which bores intersect said first and second passages.

5. The compensating means of claim 1 wherein said bleed passage meters the flow of fluid from said fluid pressure actuated member to said low pressure zone in relation to such restricted communication thereof with said high pressure zone to seek to maintain said pressure differential at predetermined value.

6. The compensating means of claim 1 wherein said first opposed areas of said valve member are substantially equal.

7. The compensating means of claim 1 wherein said orifice means and said restricted communication are constituted by openings in said valve member which respectively communicate said high pressure zone with said other side of said valve member and with said fluid pressure actuated member in the bleed passage opening and closing positions of said valve member.

8. Compensating means for a variable displacement pump of the type comprising a housing having pump means, high and low fluid pressure zones, and a fluid pressure actuated member having restricted communication with said high pressure zone and operatively engaged with said pump means to vary the displacement thereof; said compensating means comprising a valve member movable in said housing between positions opening and closing a bleed passage from said fluid pressure actuated member to said low pressure zone; spring means in said housing biasing said valve member to a position closing said bleed passage; said valve member having first opposed areas including an area on one side exposed to fluid pressure in said high pressure zone and having an area on the other side exposed to fluid pressure in said high pressure zone via orifice means; said valve member having second opposed areas respectively exposed to fluid pressure in said high pressure zone and to a fluid pressure sensing passage in said housing which is communicated with the downstream side of a variable area orifice in the pressure feed path between said high pressure zone and a fluid motor actuated by fluid flowing from said high pressure zone through said variable area orifice; said spring means retaining said valve member in said bleed passage closing position when the differential in fluid pressures acting on said second opposed areas is less than predetermined value; a horsepower compensating pilot valve in said housing operative, upon increase of fluid pressure in said high pressure zone to predetermined value, to open communication between said other side of said valve member and said low pressure zone for movement of said valve member by the then predominant fluid pressure acting on said one side of said valve member to open said bleed passage to bleed fluid pressure acting on said fluid pressure actuated member to said low pressure zone with consequent movement of said fluid pressure actuated member in pump displacement decreasing direction; said pilot valve including a spring biased pilot valve member having a spring follower engaged with a cam surface on said fluid pressure actuated member operative to increase the spring bias on said pilot valve member as said fluid pressure actuated member moves in a displacement decreasing direction; the aforesaid pressure differential, when exceeding such predetermined value, effecting movement of said valve member against said spring means to open said bleed passage to bleed said fluid pressure actuated member to said low pressure zone while said pilot valve is closed whereby said fluid pressure actuated member moves in a displacement decreasing direction.

9. The compensating means of claim 8 wherein said housing has adjustment means for said spring means to change the pressure differential at which said valve member is moved to bleed passage opening position while said pilot valve is closed.

10. The compensating means of claim 8 wherein said bleed passage meters the flow of fluid from said fluid pressure actuated member to said low pressure zone in relation to such restricted communication thereof with said high pressure zone to seek to maintain said pressure differential at predetermined value.

11. The compensating means of claim 8 wherein said first opposed areas of said valve member are substantially equal.

12. The compensating means of claim 8 wherein said orifice means and said restricted communication are constituted by openings in said valve member which respectively communicate said high pressure zone with said other side of said valve member and with said fluid pressure actuated member in the bleed passage opening and closing positions of said valve member.

13. The compensating means of claim 8 wherein said housing has a first passage communicating said other side of said valve member with the upstream side of said pilot valve, and a second passage communicating the downstream side of said pilot valve with said low pressure zone whereby the opening of said pilot valve effects movement of said valve member to open said bleed passage to bleed fluid pressure acting on said fluid pressure actuated member to said low pressure zone.

14. The compensating means of claim 13 wherein said pilot valve is disposed in a bore in said housing which intersects said first and second passages.

* * * * *